United States Patent [19]

Fitzpatrick

[11] 4,433,644

[45] Feb. 28, 1984

[54] STEAM BOILERS

[76] Inventor: James J. Fitzpatrick, 317 Airdale Rd., Rosemont, Pa. 19011

[21] Appl. No.: 319,017

[22] Filed: Nov. 6, 1981

[51] Int. Cl.[3] ..... F22B 9/02

[52] U.S. Cl. ..... 122/114; 122/511; 122/DIG. 13; 110/323; 110/326

[58] Field of Search ..... 110/216, 217, 322–326; 122/13 R, 15, 16, 17, 18, 44 A, 114, 117, 155 A, 155 R, 511, DIG. 13; 285/55, 291; 55/462, 463, 465; 29/157.4, 158, 157.3 C

[56] References Cited

U.S. PATENT DOCUMENTS

| | | | |
|---|---|---|---|
| 62,953 | 3/1867 | Hafer | 122/155 A |
| 98,089 | 12/1869 | Montgomery | 122/114 X |
| 218,393 | 8/1879 | Miller . | |
| 304,869 | 9/1884 | Shealy | 122/155 A |
| 508,973 | 11/1893 | Whitney | 110/326 |
| 732,508 | 6/1903 | Boone . | |
| 814,074 | 3/1906 | Pierce . | |
| 934,679 | 9/1909 | Lea | 122/114 X |
| 1,085,159 | 1/1914 | Raab | 55/463 X |
| 1,151,676 | 8/1915 | Foersterling . | |
| 1,152,421 | 9/1915 | Killman . | |
| 1,185,135 | 5/1916 | Seaman . | |
| 1,907,736 | 5/1933 | Cheetham et al. . | |
| 3,668,833 | 6/1972 | Cahill | 110/216 X |
| 3,781,966 | 1/1974 | Lieberman | 29/157.4 |
| 3,976,033 | 8/1976 | Csathy | 122/114 X |
| 4,271,789 | 6/1981 | Black | 122/16 X |
| 4,317,417 | 3/1982 | Foresto | 110/216 X |

*Primary Examiner*—Henry C. Yuen
*Assistant Examiner*—David E. Helmbold
*Attorney, Agent, or Firm*—Seidel, Gonda & Goldhammer

[57] ABSTRACT

Two types of boilers for generating high pressure steam from gaseous effluents containing abrasive and corrosive solids are provided. Both types of boilers are vertical boilers of the fire-tube type with the gas flowing within the boiler tubes and with the water and steam surrounding the boiler tubes.

In one type of boiler according to this invention, the solids-containing gas is downfed through the boiler tubes with the gas emerging from the tubes and impinging on a concave, conical deflector and a convex nose cone located below the deflector. The deflector and nose cone serve to disengage solids from the gas.

In the other type of boiler according to the invention, the solids-containing gas first impinges on a baffle plate which serves to disengage solids from the gas. The solids flow down for removal, while the gas flows up the boiler tubes to generate steam.

14 Claims, 10 Drawing Figures

FIG. 2
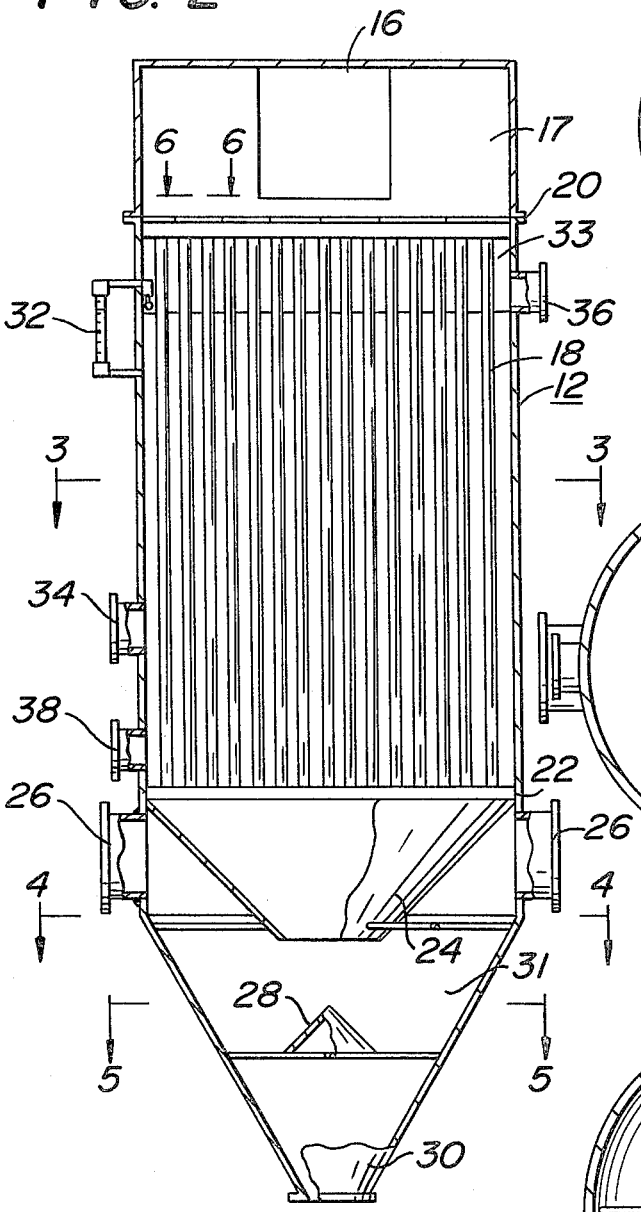
FIG. 5
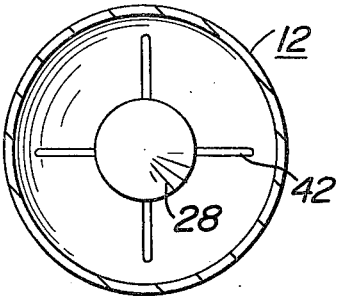
FIG. 3
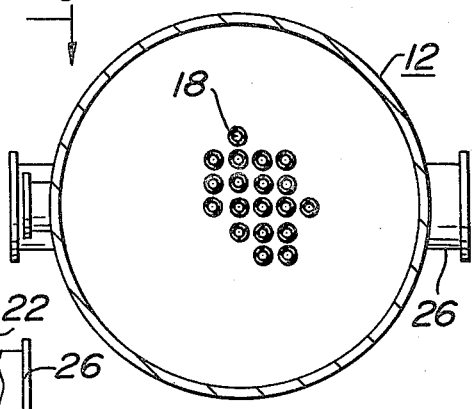
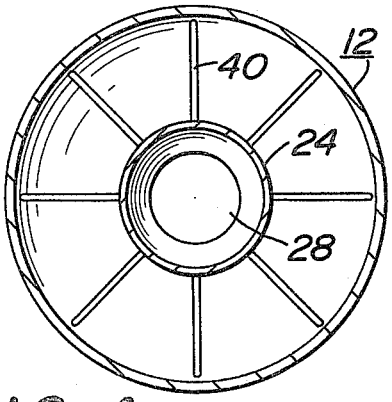
FIG. 4

FIG. 6
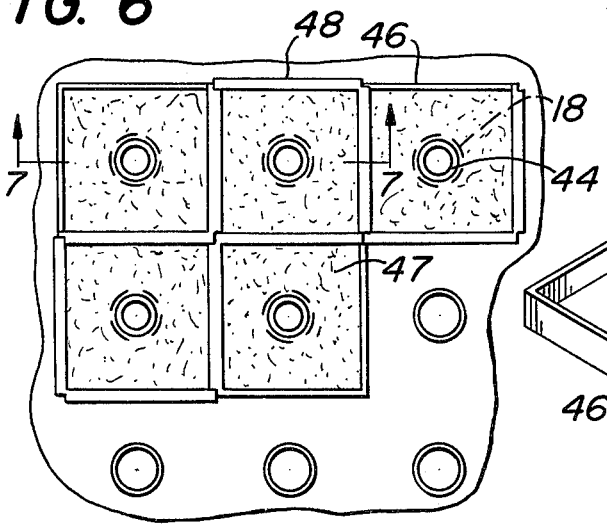
FIG. 8
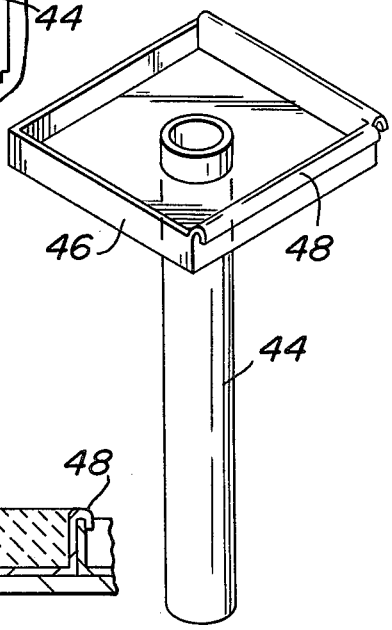
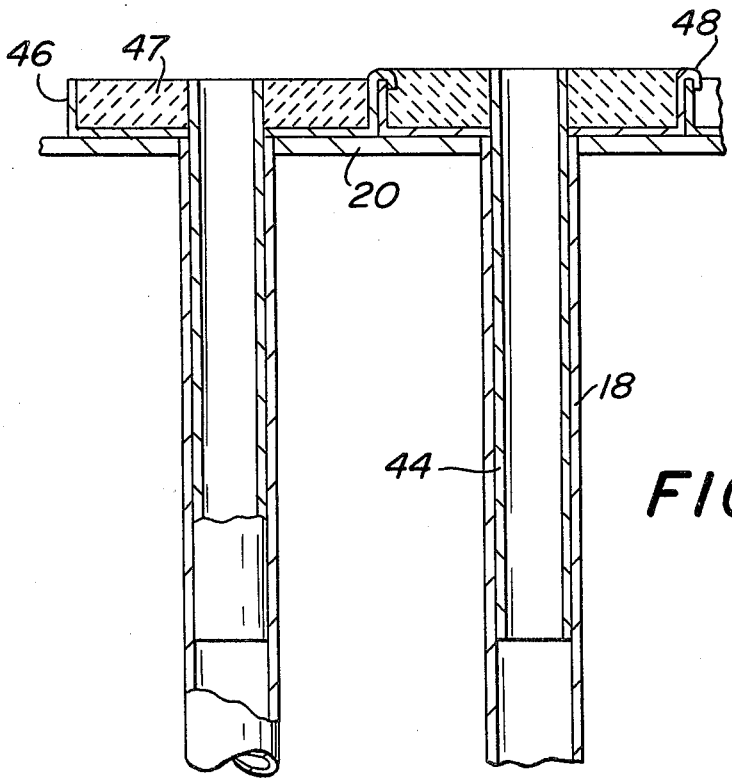
FIG. 7

STEAM BOILERS

BACKGROUND OF THE INVENTION

The present invention concerns boilers for generating steam and removing solids from high temperature, solids-containing gaseous effluents.

Steam is the foremost vehicle for power generation in the world. About 90% of the new electric capacity being installed utilizes steam. In the eighteenth century, a "shell" boiler, little more than a ketttle filled with water and heated at the bottom, was the most common source of industrial steam. This, in turn, was followed by early versions of the "fire-tube" boiler such as the Trevithick boiler. John Stevens, a lawyer instrumental in the passage of this nation's first patent act, patented a "water-tube" boiler in 1803.

Steam was originally utilized to provide heat and power for local industrial use. With the advent of practical electrical power generation and distribution, utility companies were formed to serve both residential and commercial users. By 1881 the first electric generating station in the United States utilizing steam was operating in Philadelphia.

Modern boilers are generally of the "water-tube" type. In this type of boiler, the water and steam are inside the tubes and the hot gases generated by the combustion of fuel such as natural gas, oil or coal, are in contact with the outer tube surfaces.

A less common type of boiler is the "fire-tube" boiler. In this boiler, the hot gaseous products of combustion pass directly through the tubes. The tubes are surrounded by water contained in a vessel. "Fire-tube" boilers are designed for vertical, inclined or horizontal positions. The preferred position being horizontal.

"Fire-tube" boilers represent only a small fraction of the steam generating devices presently in use. Many of the "fire-tube" boilers currently in service are used for heating small buildings. The demise of "fire-tube" boilers in larger sizes for process steam generation is a result of their large volume of water compared to their heating surfaces. Thus in case of mechanical failure due to tube burnout there can be an explosive release of a large quantity of steam.

SUMMARY OF THE INVENTION

This invention relates to vertical fire-tubes boilers for generating steam and removing solids from high temperature, solids-containing gas streams. In one type of boiler according to this invention which is referred to herein as the "particulate boiler", the boiler housing is a vessel for retaining water at a predetermined level so as to create a vapor space above the water level. A plurality of boiler tubes for receiving the gaseous effluent is disposed throughout the length of the vessel and thus the tubes are partially within the vapor space and partially within the water. Protective sleeves are disposed within the tubes with the sleeves extending in the tubes from the top of the tubes to no greater than the water level in the vessel to protect that portion of the tubes within the vapor space. A concave, conical deflector is located adjacent the bottom of the tubes and a convex nose cone, located below the deflector, both serve to disengage the solids from the gas and to direct the solids to a solids outlet positioned at the bottom of the vessel. A gas outlet is located adjacent the bottom of the tubes. This boiler may further contain a nose cone located between the deflector and the solids outlet to further aid the disengagement of the solids from the gas. Although the normal flow of gas through the boiler is downflow, the flow can be reversed such as in a cleaning cycle.

Another vertical fire-tube boiler in accordance with this invention which is referred to herein as the "waste heat boiler", includes a vessel for retaining water at a predetermined level so as to create a vapor space above the water level. Within the vessel are a plurality of boiler tubes for receiving the gaseous effluent. A gas inlet is located adjacent to the bottom of the tubes. A baffle plate is disposed in the path of the gas emerging from the gas inlet to aid in the disengagement of the solids from the gas. A solids outlet is located at the bottom of the vessel. A gas outlet is located at the top of the vessel to serve as an exit for the gaseous effluent emerging from the tubes. The gas flow in this boiler can also be reversed such as in a cleaning cycle.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 2 is an elevational view, partially in cross-section taken along line 2—2 of FIG. 1 showing a particulate boiler of this invention in greater detail.

FIG. 3 is plan view taken along line 3—3 of FIG. 2 showing a cross-section of the boiler tubes of the particulate boiler.

FIG. 4 is a plan view taken along line 4—4 of FIG. 2 showing the deflector supports of the particulate boiler.

FIG. 5 is a plan view taken along line 5—5 of FIG. 2 showing a top view of the nose cone of the particulate boiler.

FIG. 6 is a plan view taken along line 6—6 of FIG. 2 showing the sleeve retainer boxes of the particulate boiler.

FIG. 7 is an elevational view taken along line 7—7 of FIG. 6 showing the protective sleeves, boiler tubes and sleeve retainer boxes (containing castable refractory) of the particulate boiler.

FIG. 8 is an elevational view showing a single sleeve and retainer box.

DETAILED DESCRIPTION OF THE INVENTION

Figure 1:
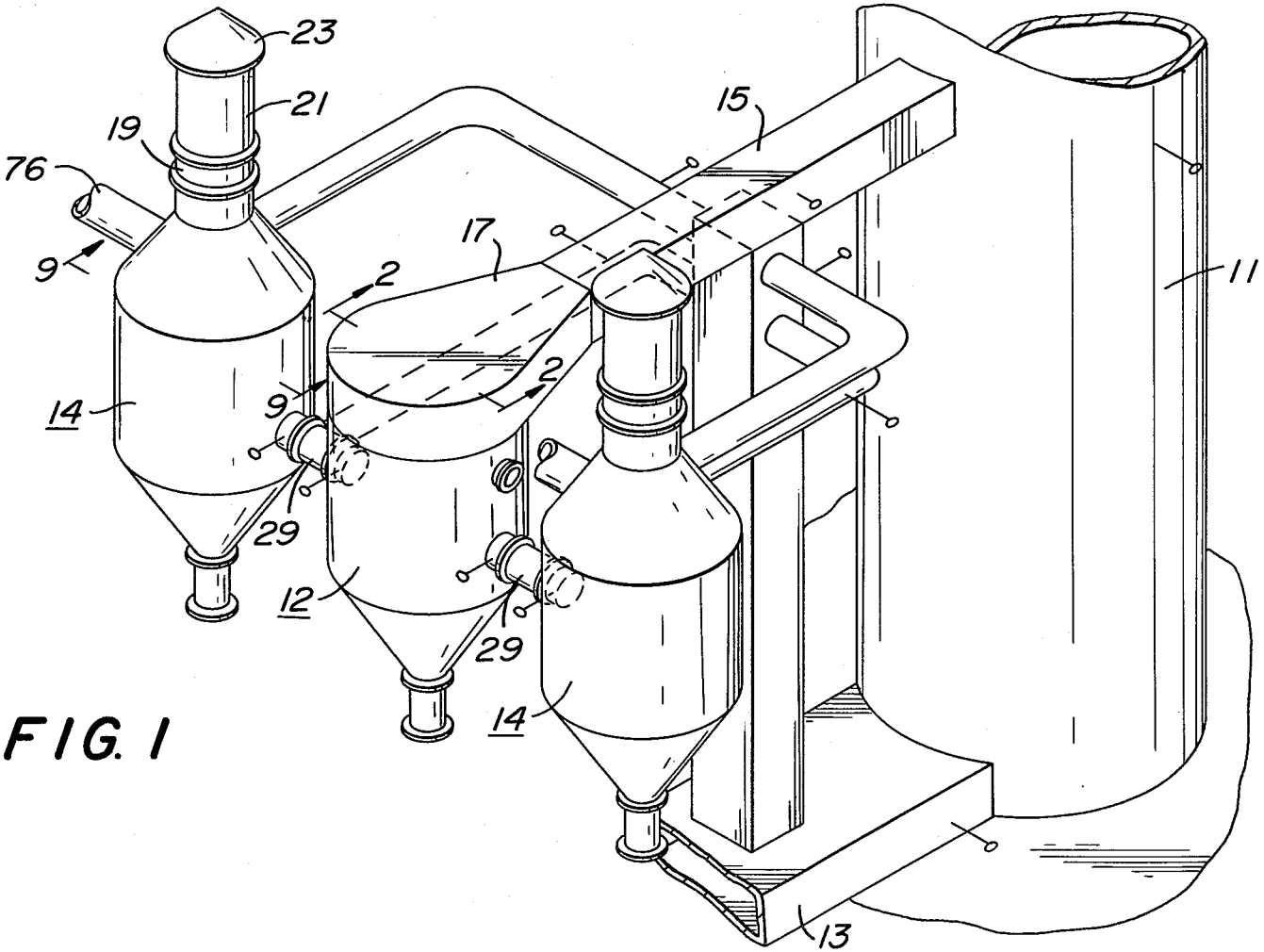
FIG. 1 is a perspective view showing a particulate boiler and waste heat boilers according to this invention in a boiler system which is adjacent to an existing stack.
Figure 10:
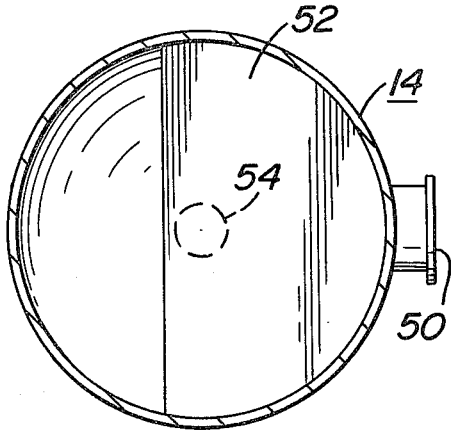
FIG. 10 is a plan view taken along line 10—10 of FIG. 1 showing the baffle plate of the waste heat boiler.

Referring to the drawings, wherein like numerals indicate like elements, there is shown in FIG. 1 a boiler system utilizing the boilers of this invention. Solids-containing effluent gas flowing in furnace tunnel 13 into stack 11 of an existing facility is diverted so as to flow through primary duct 15. The gas is then blown downwards by induced draft and forced draft fans (not shown) through particulate boiler 12 into conduits 29 and up into two waste heat boilers 14 which flank the particulate boiler 12. The gas from the waste heat boiler 14 is vented to the atmosphere by the use of induced draft fans 19 through stacks 21 having rain hoods 23.

The boiler system is described in greater detail in my copending application Ser. No. 319,015, filed on even date herewith and entitled "Steam Boiler System".

FIG. 2 depicts the particulate boiler 12 in detail. Gaseous solids-containing effluent flows horizontally into the particulate boiler 12 through the particulate boiler gas-solids inlet 16 into header 17 and then downward. The header 17 can be fabricated from any suitable material such as, for example, stainless steel. The gaseous solids-containing effluent then passes through numerous boiler tubes 18 supported by a top tube sheet 20. The boiler tubes 18 are constructed from a material that provides suitable heat transfer such as carbon steel. The boiler tubes 18 can be any convenient size. The size of the tubes would depend on the flowrate of gas and solids and the temperature and pressure of the effluent. The number of boiler tubes 18 would depend on heat transfer. The boiler tubes 18 are supported at the bottom thereof by a bottom tube sheet 22 and the top thereof by top tube sheet 20. Both the top tube sheet 20 and the bottom tube sheet 22 are constructed from suitable material such as carbon steel.

The gaseous effluent containing solids exits the boiler tubes 18 and flow through a concave, conical deflector 24 which serves to partially disengage the solids from the gas and to direct the solids to a convex nose cone 28. The gas flows around the deflector 24 and exits the particulate boiler 12 through two horizontally disposed gas outlets 26. The gas outlets 26 are connected to conduits 29 (see FIG. 1) which are respectively linked to the two waste heat boilers 14 that flank the particulate boiler 12.

The side walls of the deflector 24 are disposed at any suitable angle from the horizontal such as between about 15° and about 75°, and more particularly between about 25° and about 50°. This angle, the opening of the deflector, the distance between the deflector and the nose cone and the included angle of the nose cone are of such dimensions so as to maximize disengagement of solids. Both the deflector 24 and nose cone 28 may be constructed from any suitable material such as carbon steel. The deflector 24 may be perforated for further disengagement of solids. The deflector 24 may be constructed from any suitable material such as, for example, carbon steel or stainless steel.

The solids pass around the nose cone 28 and exit the particulate boiler 12 via solids outlet 30. The nose cone 28 serves to break-up large particulates. The nose cone 28 can be fabricated from any suitable material such as, for example, stainless steel. The included angle of the apex of the nose cone can be any suitable angle, for example, between about 20° and about 60°. The bottom portion of the particulate boiler 12 has a solids disengagement section 31. The solids disengagement section 31 (collector hopper) is in the shape of an inverted, truncated cone and functions as a hopper to remove solids. The side walls of the solids disengagement section 31 are disposed from the horizontal at a suitable angle such as between about 45° and 20°. A rotary feeder (not shown) located at solids outlet 30 facilitates the exit of solids from the particulate boiler 12.

A predetermined water level is maintained in the particulate boiler 12 by level control 32. The space above the water level is a vapor space 33 which is occupied by the steam generated in the boiler. The level of water maintained in the particulate boiler 12 and the volume of vapor space 33 depends on the amount of steam produced and the steam conditions (pressure and temperature). The particulate boiler 12 can operate as a boiler feedwater preheater (economizer-heat exchanger), rather than a steam generator. In such case, the vapor space 33 is nil and water completely surrounds the full length of the boiler tubes 18.

Boiler feedwater enters the particulate boiler 12 via the boiler feedwater makeup inlet 34. Steam exits the particulate boiler 12 through steam outlet 36. Blowdown from the particulate boiler 12 leaves the vessel through blowdown outlet 38. The water and steam in the particulate boiler 12 are segregated from the gaseous-solids effluent at the top of the vessel by top tube sheet 20 and at the bottom of the vessel by bottom tube sheet 22.

FIG. 3 shows a top view depicting the layout of the tubes in the particulate boiler 12. The boiler tubes 18 are layed out on a square pitch to facilitate water side cleaning of the boiler.

A top view of the deflector 24 is shown in FIG. 4. The deflector 24 is supported in the particulate boiler 12 by means of four to eight rods 40. These rods 40 can be fabricated from metal, such as stainless steel.

In FIG. 5, a top view is shown for the nose cone 28. The nose cone 28 is held in place by means of two to four spiders 42. The spiders can be one-half inch diameter stainless steel rods.

In FIGS. 6 through 8, protective sleeves 44 for the particulate boiler 12 are depicted. The protective sleeves 44 extend within the boiler tubes 18 from the top of the boiler tubes 18 to the water level in the particulate boiler 12 so as to protect that portion of the boiler tubes 18 in the vapor space 33. The protective sleeves 44 are fabricated from a material such as stainless steel to withstand the corrosion, erosion and abrasiveness of the hot, solids containing gaseous effluent. The diameter of the protective sleeves 44 will be dictated by the diameter of the boiler tubes 18. Thus, for example, sleeves 44 fabricated from 3" Schedule pipes would be utilized for four inch outside diameter boiler tubes. Those sections of the boiler tubes 18 which are not shielded by protective sleeves 44 derive their protection from the cooling effect of the water in the particulate boiler 12. The purpose of the protective sleeves 44 is to shield the boiler tubes 18 from the high temperature, corrosive effluent for only part of the boiler tube length. If the protective sleeves 44 were to cover the entire inner surface of the boiler tubes 18, the heat transfer rate of the boiler tubes 18 would be severely reduced.

The protective sleeves 44 are held in place on the top tube sheet 20 of the particulate boiler 12 by means of sleeve retainer boxes 46. The retainer boxes are generally square and are constructed from stainless steel. The retainer boxes 44 are filled with castable refractory 47 (see FIG. 7) to withstand the high temperatures of the gaseous effluent. A typical sleeve box 44 would be an eight inch square having a four inch depth. Locking clips 48 serve to connect the sleeve retainer boxes 46 to each other.

Figure 9:
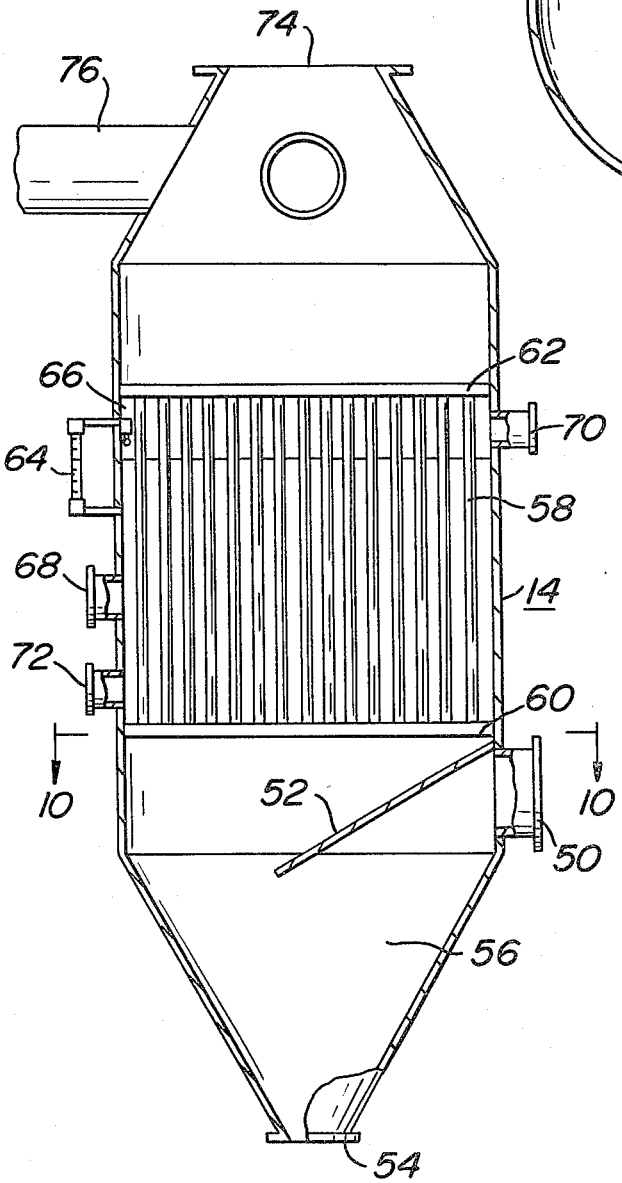
FIG. 9 is an elevational view taken along line 9—9 of FIG. 1 showing the waste heat boiler of this invention in greater detail.

FIGS. 9 and 8 show the waste heat boiler 14 of the present invention. Effluent solids-containing gas from the particulate boiler 12 enters the waste heat boiler 14 via gas inlet 50. The incoming gas directly impinges on baffle plate 52, which is positioned adjacent to gas inlet 50. The baffle plate 52 serves to knock-out solids from the gas. The baffle plate 52, constructed from any suitable material such as carbon steel, is disposed at any suitable angle from the horizontal such as between about 15° and about 75°, more particularly between about 25° and about 50°. The baffle plate 52 can be a flat plate or curved so as to extend from 5° to 360° adjacent the circumference of the waste heat boiler 14. The size of baffle plate 52 is dependent on the diameter of the gas inlet 50 and the desired degree of solids knock-out. Generally, the larger the diameter of the gas inlet, the longer the length of baffle plate 52. The baffle plate 52 directs the exit of solid particles through solids outlet 54. The bottom portion of the waste heat boiler 14 is the solids disengagement section 56. The solids disengagement section 56 is in the shape of an inverted, truncated cone and functions as a hopper to remove solids. The solids disengagement section 56 is disposed from the horizontal at a suitable angle such as between about 45° and about 20°. A rotary feeder (not shown) located at solids outlet 54 aids in the withdrawal of solids from the waste heat boiler 14.

After solids disengagement, the gas flows upwards through boiler tubes 58. The waste heat boiler tubes 58 are typically carbon steel tubes. The boiler tubes 58 can be of any suitable diameter such as 2" o.d. The boiler tubes 58 are supported at the bottom by lower tube sheet 60 and at the top by upper tube sheet 62.

Water is maintained at a predetermined level in the waste heat boiler 14 by level control 64. The space above the water level is a vapor space 66 which is occupied by the steam generated in the waste heat boiler 14. The level of water maintained in the waste heat boiler 14 and the volume of the vapor space 66 depend on the amount of steam produced and the steam conditions (pressure and temperature).

Boiler feedwater enters the waste heat boiler 14 via boiler feedwater makeup inlet 68. Steam exits the waste heat boiler 14 through steam outlet 70. Blowdown from the waste heat boiler 14 leaves through blowdown outlet 72. The effluent gas from the waste heat boiler tubes 58 exits the waste heat boiler 14 through the gas outlet 74. The gas from the waste heat boiler 14 can be vented to the atmosphere as shown in FIG. 1, or can be directed to an air pollution control device (not shown), such as an electrostatic precipitator, cyclone, scrubbing unit or a combination of such devices. The waste heat boiler 14 can have a post burner 76 downstream of stack 21 to maintain a certain temperature, such as 450° F. The post burner 76 allows for sufficient heating of the exit gas to avoid condensing water in the gas which can form corrosive solutions with the solids.

The waste heat boilers 14 may in some instances also be equipped with protective sleeves such as those described herein for the particulate boiler. In normal use, however, it is anticipated that the protective sleeves will not be required for the boiler tubes since the gas temperature has already been lowered and particulate loading has been reduced before the gas reaches the upper section of the boiler tubes 58.

The boilers of this invention can be utilized in many existing facilities such as coal gasification plants, acid plants and glass making plants.

The boilers of the present invention have a primary purpose of recovering waste heat and converting same to steam. As a secondary purpose, the boilers of this invention serve to reduce particulate matter from solids-containing effluent gases such as to act as an air pollution control unit or as an adjunct to an air pollution control system, such as an electrostatic precipitator.

By way of example, the following is offered as a typical gas analysis such as that from an effluent of a glass manufacturing facility that can be utilized in the boilers of the present invention:

| | |
|---|---|
| Flue Gas Temperature | 1200° F. to 2000° F. |
| Flue Gas Flow | 3,025,000 Standard dry CFH |
| Flue Gas Analysis | |
| % $O_2$ | 7.6 |
| % $CO_2$ | 8.4 |
| % $H_2O$ | 13.2 |
| $NO_x$ (nitrous oxides) Concentration | 1296 ppm |
| $NO_x$ (nitrous oxides) Emission | 555.5 lb/hr. |
| $SO_2$ Concentration | 31.4 ppm |
| $SO_2$ Emission | 18.6 lb/hr. |
| $SO_3$ Concentration | .7 ppm |
| $SO_3$ Emission | 0.6 lb/hr. |
| Particulate (90% $Na_2SO_4$) | |
| Concentration | .076 gr/scfd |
| Emission | 32.4 lb/hr. |

Based on the above example, the particulate boiler 12 would have the following dimensions:

| | |
|---|---|
| Inside Diameter | 10 feet |
| Total Length | Approximately 29 feet |
| Total Length of Boiler Section | 15 feet |
| Steaming Water Level | 11 feet |
| Length of Header | 4 feet |
| Boiler Tubes and Sleeves | Approximately 4" o.d. tubes; 12 feet long; sleeves extending 3 feet within tubes; 3" Schedule Pipes as sleeves |
| Length of Deflector | 3 feet |
| Diameter of Nose Cone | Approximately 3 feet |
| Length of Solids Disengagement Section | 7 feet |

Each of two waste heat boilers 14 would have the following dimensions based on the above example:

| | |
|---|---|
| Total length | Approximately 28 feet |
| Total Length of Boiler Section | 9 feet |
| Length of Solids Disengagement Section | Approximately 7½ feet |
| Diameter of Boiler Tubes | 2 inches |

The boilers of the present invention provide the following advantages:

(1) the use of sleeves fabricated from a material which can withstand corrosion, erosion and high temperatures serves to protect tubes fabricated from less expensive material, such as carbon steel and thus reduce the cost of the boilers;

(2) the particulate boiler of this invention has the ability to serve either as an economizer (water preheater) to each of the waste heat boilers or as a separate fired steam boiler unto itself without the need for a steam drum;

(3) the particulate boiler which is downfed can be used to preheat water, generate steam, or do both simultaneously;

(4) the gas flow through the boilers of this invention can be reversed to aid in cleaning of the boiler tubes;

(5) a straight single pass drop through the tubes is provided;

(6) the sleeves are interlocking which provides a total protective field for the boiler tube sheet and boiler tubes;

(7) the sleeves are removable, cleanable, reusable and replaceable; and (8) solid particles down to about 325 mesh can be removed.

The boilers of the present invention can produce 185 psi (approximately 400° F.) steam for direct plant usage. This steam could also be superheated and utilized in a compatible turbo electric generator for direct electrical generation with an 18 psi steam exhaust. The 18 psi exhaust system can be used in winter for plant heating and in the summer for recuperative air conditioning systems. The 185 psi steam can also be used throughout plants for direct drive of air compressors, turbine driven fans and in all instances where large electrical driven motors are presently in use.

The present invention may be embodied in other specific forms without departing from the spirit or essential attributes thereof and, accordingly, reference should be made to the appended claims, rather than to the foregoing specification, as indicating the scope of the invention.

I claim:

1. A boiler comprising a vessel, a plurality of tubes in said vessel connected at their ends to first and second tube sheets, said vessel having an inlet for high temperature gaseous effluent adjacent said first tube sheet and communicating with one end of said tubes, said vessel having an outlet communicating with the other end of said tubes, a metallic protective sleeve disposed within the inlet end portion of said tubes, a refractory juxtaposed to said first tube sheet and coupled to one end portion of said sleeves without interfering with flow through the sleeves, a retainer secured to each sleeve, said refractory including refractory members, each refractory member being coupled to one of said retainers for movement as a unit with its associated sleeve, each retainer and its sleeve being removably supported by said first tube sheet, and each retainer being an open top box, each refractory member being disposed in one of said boxes.

2. A vertical fire-tube boiler for generating steam and removing solids from a high temperature, solids containing gaseous effluent comprising a vessel for retaining water at a predetermined level so as to create a vapor space above said water level, a gas inlet at the top of said vessel, a plurality of boiler tubes for receiving said gaseous effluent, said tubes partially disposed within said vapor space and partially within said water, a steam outlet communicating with said vapor space, protective sleeves disposed within said tubes, said sleeves extending in said tubes from the top of said tubes to no greater than the water level in said vessel to protect that portion of said tubes in said vapor space, a concave, conical deflector located adjacent the bottom of said tubes, a convex nose cone located below said deflector, said deflector and said nose cone cooperating to disengage the solids from said gaseous effluent and to direct the solids to a solids outlet positioned at the bottom of said vessel, a gas outlet located adjacent the elevation of the bottom of said tubes, and each of said sleeves including a retainer box at the upper portion thereof.

3. The boiler of claim 1 wherein said retainer box is filled with castable refractory.

4. The boiler of claim 1 wherein said retainer boxes are connected to each other by clip means.

5. The boiler of claim 1 wherein said retainer box is fabricated from stainless steel.

6. The boiler of claim 1 wherein said sleeves are fabricated from stainless steel.

7. The boiler of claim 1 wherein said sleeves are removable.

8. The boiler of claim 1 wherein said gaseous effluent flows downward in said boiler.

9. The boiler of claim 1 wherein said tubes are carbon steel tubes.

10. The boiler of claim 1 wherein said tubes are 4 inch outer diameter tubes.

11. The boiler of claim 1 wherein the bottom portion thereof is in the shape of an inverted, truncated cone so as to function as a hopper.

12. A boiler in accordance with claim 2 wherein said tubes are made of a metal capable of withstanding corrosion and high temperatures, a retainer connected to the upper ends of said sleeves, each retainer supporting a layer of refractory, said layers of refractory being rectangular in plan view.

13. A vertical fire-tube boiler for generating steam and removing solids from a high temperature, solids containing gaseous effluent comprising a vessel for retaining water at a predetermined level so as to create a vapor space above said water level, a gas inlet at the top of said vessel, a plurality of boiler tubes for receiving said gaseous effluent, said tubes being partially disposed within said vapor space and partially within said water, a steam outlet communicating with said vapor space, protective sleeves disposed within said tubes, said sleeves extending into said tubes from the top of said tubes to no greater than the water level in said vessel to protect that portion of the tubes in said vapor space, a concave conical deflector located adjacent the bottom of said tubes, a convex nose cone located below said deflector, said deflector and said nose cone cooperating to disengage the solids from said gaseous effluent and to direct the solids to a solids outlet positioned at the bottom of said vessel, and a gas outlet located adjacent the elevation of the bottom of said tubes, said steam outlet being at the elevation of said tubes, the upper ends of said tubes being connected to a tube sheet, a plurality of refractory members overlying said tube sheet, each refractory member being coupled to one of said sleeves, said sleeves being made of metal, the peripheries of said refractory members being adjacent one another so as to provide a protective layer for said tube sheet.

14. A boiler in accordance with claim 13 wherein said tubes are arranged in a square pitch pattern.

* * * * *